US011172802B2

(12) United States Patent
Bloomer et al.

(10) Patent No.: US 11,172,802 B2
(45) Date of Patent: Nov. 16, 2021

(54) BRUSHROLL FOR A FLOOR CLEANER

(71) Applicant: Techtronic Cordless GP, Anderson, SC (US)

(72) Inventors: Ryan Bloomer, Charlotte, NC (US); Juan Aviles Quintero, Huntersville, NC (US); Mohammed Irfan, Huntersville, NC (US); John Morphey, Concord, NC (US)

(73) Assignee: Techtronic Cordless GP, Anderson, SC (US)

( * ) Notice: Subject to any disclaimer, the term of this patent is extended or adjusted under 35 U.S.C. 154(b) by 0 days.

(21) Appl. No.: 17/083,959

(22) Filed: Oct. 29, 2020

(65) Prior Publication Data

US 2021/0127931 A1 May 6, 2021

Related U.S. Application Data

(60) Provisional application No. 62/928,678, filed on Oct. 31, 2019.

(51) Int. Cl.
*A47L 11/30* (2006.01)
*A47L 11/40* (2006.01)

(52) U.S. Cl.
CPC ..... *A47L 11/302* (2013.01); *A47L 11/4016* (2013.01); *A47L 11/4041* (2013.01); *A47L 11/4083* (2013.01); *A47L 11/4088* (2013.01)

(58) Field of Classification Search
CPC ..... A47L 11/302; A47L 11/4016; A47L 11/4041; A47L 11/4083; A47L 11/4088
See application file for complete search history.

(56) References Cited

U.S. PATENT DOCUMENTS 2,101,133 A 12/1937 Dilliard
2,502,403 A 3/1950 Kircher
(Continued)

FOREIGN PATENT DOCUMENTS

AU 2005229624 A1 9/2006
CN 104545689 A 4/2015
(Continued)

OTHER PUBLICATIONS

International Search Report and Written Opinion for Application No. PCT/US2020/057936 dated Mar. 2, 2021 (12 pages).

*Primary Examiner* — Dung Van Nguyen
(74) *Attorney, Agent, or Firm* — Michael Best & Friedrich LLP

(57) ABSTRACT

A cleaning head housing for a floor cleaner that moves along a surface to be cleaned includes a brushroll chamber defining a top surface having a top opening and a bottom surface having a bottom opening positioned closer to the surface to be cleaned than the top opening. A suction nozzle has an upper nozzle wall, a lower nozzle wall, and a nozzle passageway formed between the upper and lower nozzle walls. The suction nozzle is releaseably connected to the brushroll chamber to selectively cover the top opening of the brushroll chamber. A brushroll is positioned within the brushroll chamber and engages the surface to be cleaned through the bottom opening of the brushroll chamber. The brushroll is accessible through the top opening for cleaning while the suction nozzle is disconnected from the brushroll chamber. The brushroll is removable from the brushroll chamber other than through the top opening.

20 Claims, 3 Drawing Sheets

(56) References Cited

U.S. PATENT DOCUMENTS

| | | | | |
|---|---|---|---|---|
| 2,962,740 | A | 12/1960 | Plantholt | |
| 3,003,170 | A | 10/1961 | Lathrop | |
| 4,980,945 | A | 1/1991 | Bewley | |
| 5,063,634 | A | 5/1991 | Hafele et al. | |
| 5,309,601 | A | 5/1994 | Hampton et al. | |
| 5,659,919 | A | 8/1997 | Kajihara | |
| 5,960,514 | A | 10/1999 | Miller et al. | |
| 6,073,303 | A | 6/2000 | Hinojosa | |
| 6,226,832 | B1 | 5/2001 | McCormick | |
| 6,256,832 | B1 | 7/2001 | Dyson | |
| 6,324,714 | B1 | 12/2001 | Walz et al. | |
| 7,150,069 | B2 | 12/2006 | Hori et al. | |
| 7,690,079 | B2 | 4/2010 | Boddy et al. | |
| 7,770,257 | B2 | 8/2010 | Kim | |
| 7,849,558 | B2 | 12/2010 | Ivarsson et al. | |
| 9,456,723 | B2 | 10/2016 | Thorne et al. | |
| 9,526,389 | B2 | 12/2016 | Thorne et al. | |
| D781,013 | S | 3/2017 | Ricica | |
| 9,655,486 | B2 | 5/2017 | Xu et al. | |
| 9,763,549 | B2 | 9/2017 | Hyun et al. | |
| 2005/0091783 | A1* | 5/2005 | Sepke | A47L 11/4083 15/320 |
| 2008/0092325 | A1* | 4/2008 | Vander Baan | A47L 11/4075 15/328 |
| 2010/0170059 | A1 | 7/2010 | Vrdoljak | |
| 2013/0139350 | A1 | 6/2013 | Conrad et al. | |
| 2015/0265117 | A1 | 9/2015 | Genn et al. | |
| 2015/0313434 | A1 | 11/2015 | Ruffo | |
| 2016/0220082 | A1 | 8/2016 | Thorne et al. | |
| 2016/0270620 | A1* | 9/2016 | Miller | A47L 11/34 |
| 2017/0042319 | A1 | 2/2017 | Conrad et al. | |
| 2017/0119225 | A1* | 5/2017 | Xia | A47L 5/28 |
| 2018/0344112 | A1* | 12/2018 | Krebs | A47L 11/292 |
| 2020/0069137 | A1* | 3/2020 | Nguyen | A47L 11/34 |

FOREIGN PATENT DOCUMENTS

| | | | |
|---|---|---|---|
| CN | 104887151 | A | 9/2015 |
| CN | 204744010 | U | 11/2015 |
| CN | 105496309 | A | 4/2016 |
| CN | 205514381 | U | 8/2016 |
| CN | 106037581 | A | 10/2016 |
| DE | 10110771 | A1 | 9/2002 |
| DE | 102012207357 | A1 | 11/2013 |
| EP | 0909547 | A2 | 4/1999 |
| EP | 2494899 | A2 | 9/2012 |
| GB | 2567023 | A | 4/2019 |
| WO | 2006061045 | A1 | 6/2006 |
| WO | 2007041914 | A1 | 4/2007 |

* cited by examiner

BRUSHROLL FOR A FLOOR CLEANER

CROSS-REFERENCE TO RELATED APPLICATIONS

This application claims priority to U.S. Provisional Patent Application No. 62/928,678, filed Oct. 31, 2019, the entire contents of which are hereby incorporated by reference herein.

BACKGROUND

The present disclosure relates to extractor cleaning machines, and more particularly, to brushrolls for extractor cleaning machines.

An extractor cleaning machine typically includes a brushroll for engaging a surface to be cleaned and a nozzle to extract fluid from the surface to be cleaned.

SUMMARY

In one embodiment, the disclosure provides a floor cleaner having a cleaning head housing that moves along a surface to be cleaned. The cleaning head housing includes a brushroll chamber defining a top opening and a bottom opening, and a suction nozzle having an upper nozzle wall, a lower nozzle wall, and a nozzle passageway formed between the upper nozzle wall and the lower nozzle wall. The suction nozzle is releaseably connected to the brushroll chamber to selectively cover the top opening of the brushroll chamber. A brushroll is positioned within the brushroll chamber and engages the surface to be cleaned through the bottom opening of the brushroll chamber when the cleaner is in use. The brushroll is accessible through the top opening for cleaning while the suction nozzle is disconnected from the brushroll chamber. The brushroll is removable from the brushroll chamber other than through the top opening. A body portion is pivotally connected to the cleaning head housing. A suction source is in fluid communication with the suction nozzle. The suction source is operable to draw fluid into the suction nozzle. A recovery tank is in fluid communication with the suction nozzle and the suction source. The recovery tank stores fluid drawn through the suction nozzle.

In another embodiment the disclosure provides a cleaning head housing for a floor cleaner that moves along a surface to be cleaned. The cleaning head housing includes a brushroll chamber defining a top surface having a top opening and a bottom surface having a bottom opening positioned closer to the surface to be cleaned than the top opening during operation of the floor cleaner. A suction nozzle has an upper nozzle wall, a lower nozzle wall, and a nozzle passageway formed between the upper nozzle wall and the lower nozzle wall. The suction nozzle is releaseably connected to the brushroll chamber to selectively cover the top opening of the brushroll chamber. A brushroll is positioned within the brushroll chamber and engages the surface to be cleaned through the bottom opening of the brushroll chamber when the cleaner is in use. The brushroll is accessible through the top opening for cleaning while the suction nozzle is disconnected from the brushroll chamber. The brushroll is removable from the brushroll chamber other than through the top opening.

In another embodiment the disclosure provides a floor cleaner having a cleaning head housing that moves along a surface to be cleaned. The cleaning head housing includes a brushroll chamber defining a top opening, a bottom opening, and, optionally, a side opening, and a dispensing nozzle that dispenses fluid onto the surface to be cleaned. A suction nozzle has an upper nozzle wall, a lower nozzle wall, and a nozzle passageway formed between the upper nozzle wall and the lower nozzle wall. The suction nozzle is releaseably connected to the brushroll chamber to selectively close the top opening of the brushroll chamber. A brushroll is positioned within the brushroll chamber and engages the surface to be cleaned through the bottom opening of the brushroll chamber. The brushroll is accessible through the top opening for cleaning while the suction nozzle is disconnected from the brushroll chamber. The brushroll is removable from the brushroll chamber other than through the top opening. A body portion is pivotally connected to the brushroll chamber. A supply tank supplies fluid to the dispensing nozzle. A suction source is connected to the body portion and is in fluid communication with the suction nozzle. The suction source draws fluid into the suction nozzle from the surface to be cleaned. A recovery tank is in fluid communication with the suction nozzle and the suction source to store fluid drawn through the suction nozzle.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
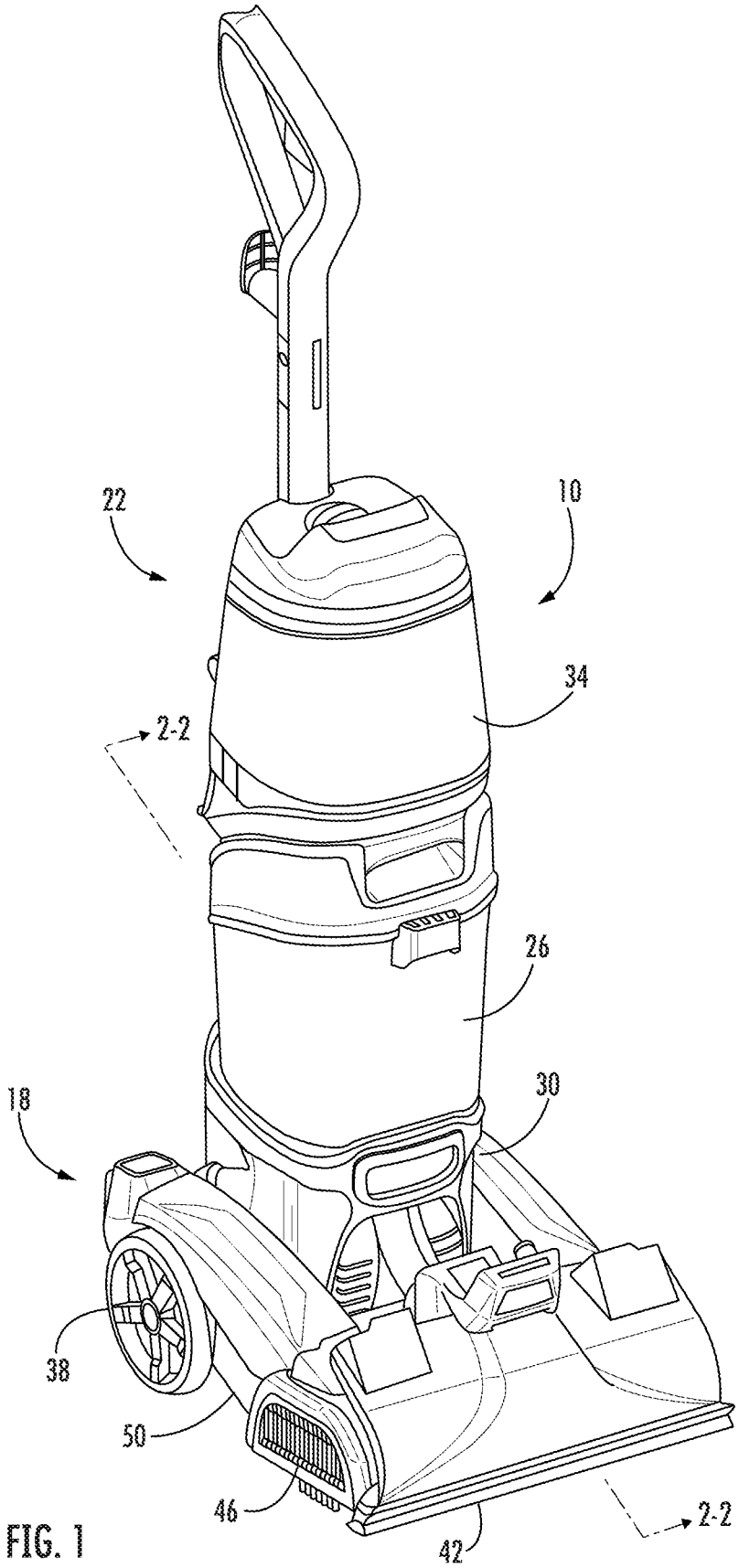
FIG. 1 is a perspective view of an extractor cleaning machine according to some embodiments of the invention.
Figure 2:
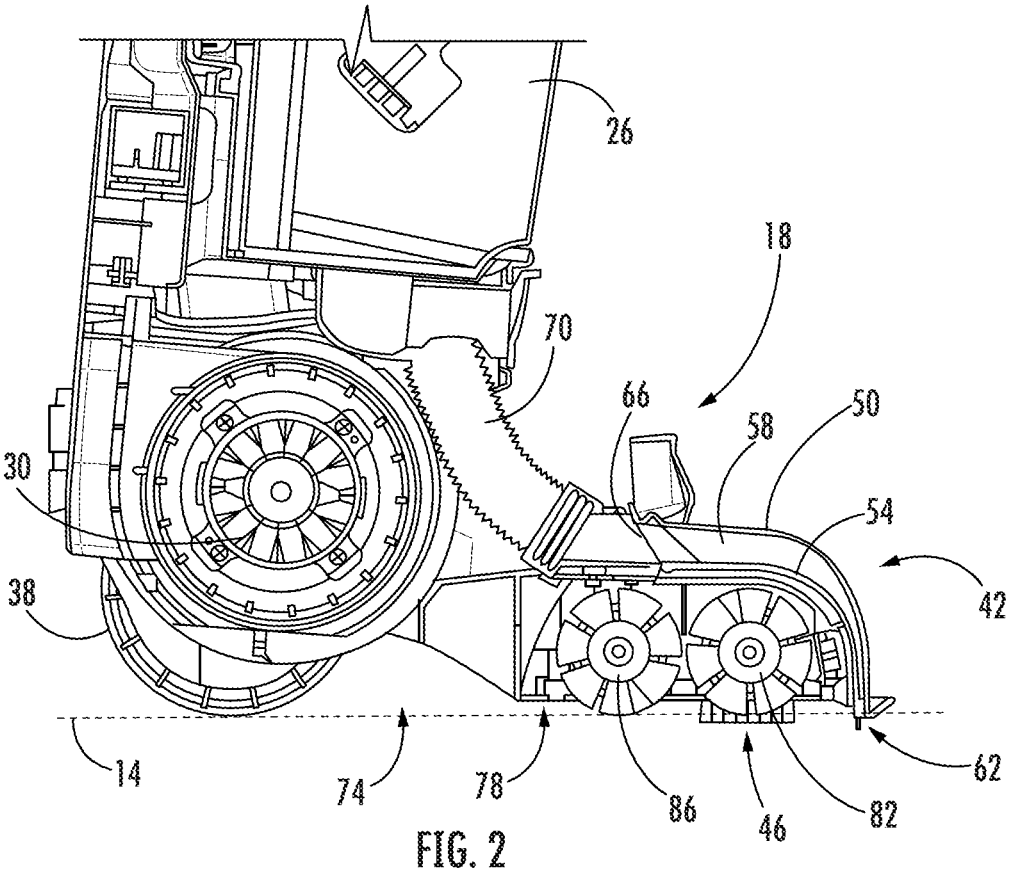
FIG. 2 is a cross-sectional view of a lower portion of the extractor cleaning machine taken alone line 2-2 of FIG. 1.

FIG. 1 illustrates an extractor cleaning machine 10 (hereinafter referred "extractor"). In the illustrated embodiment, the extractor 10 is an upright extractor operable to clean a surface 14, such as, for example, a floor (FIG. 2). In some embodiments, the extractor 10 may be adapted to clean a variety of surfaces, such as carpets, hardwood floors, tiles, or the like. A cleaning fluid (e.g., water, detergent, or a mixture of water and detergent) is dispensed onto the surface to clean the surface. In one embodiment, the extractor 10 distributes or sprays the cleaning fluid onto the surface. The extractor 10 then draws the cleaning fluid and dirt from the surface, leaving the surface relatively clean.

The illustrated extractor 10 includes a base 18, a body 22 coupled to the base 18, a recovery tank 26 coupled to the body 22, a suction source 30, a fluid distribution system (not shown), a supply tank assembly 34 coupled to the body 22, two wheels 38, a suction nozzle 42 and a brush assembly 46. A suction nozzle 42 is releasably connected to the base 18, disposed to cover a top opening in the base. The base 18 includes a brushroll 82 disposed in a brushroll chamber 78, the brushroll 82 being accessible through the top opening for cleaning while the suction nozzle 42 is disconnected from the brushroll chamber 78. The brushroll 82 is removable from the brushroll chamber 78 other than through the top opening, such as through the bottom or side of the base 18. Other extractors within the scope of the invention may include a different type of base, such as including the recovery tank and or supply tank coupled to the base.

The base 18 is movable along the surface to be cleaned. In the illustrated embodiment, two wheels 38 are coupled to the base 18 to facilitate movement of the base 18 along the surface. In other embodiments more than two wheels can be utilized. In the illustrated embodiment, the wheels 38 are idle wheels. In other embodiments, one or both of the wheels 38 may be driven wheels.

The illustrated body 22 is pivotally coupled to and extends from the base 18. The body 22 is pivotable or tiltable relative to the base 18 from a generally vertical, or upright, storage position to one or more non-vertical, or inclined, operating positions. Pivoting the body 22 to an operating position facilitates moving the base 18 along the surface 14.

The recovery tank 26 is in fluid communication with the suction nozzle 42 and the suction source 30. The recovery tank 26 is configured to store cleaning fluid and any dirt extracted from the surface 14 through the suction nozzle 42. The suction source 30 is connected to the body 22 and is in fluid communication with the suction nozzle 42. The suction source 30 draws fluid into the suction nozzle 42 from the surface to be cleaned 14.

The supply tank assembly 34 is configured to store cleaning fluid to be distributed by the extractor 10 onto the surface 14. The fluid distribution system is in fluid communication with the supply tank assembly 34 to draw cleaning fluid from the supply tank assembly 34 and distribute the fluid to the surface 14 through a distribution nozzle. In some embodiments, the fluid distribution system may include a pump that propels the cleaning fluid to the surface 14. In another embodiment, gravity moves the cleaning fluid through the distribution nozzle to the surface 14. The body 22 supports one or more actuators that control cleaning fluid delivery from the supply tank assembly 34 through a distributor and/or a distribution nozzle and onto the surface 14.

FIG. 2 illustrates the suction source 30, the second wheel 38, the suction nozzle 42 and the brush assembly 46 in greater detail. The suction nozzle 42 draws fluid and dirt from the surface into the recovery tank 26 of the extractor 10. The illustrated suction nozzle 42 has an upper nozzle wall 50, a lower nozzle wall 54, and a nozzle passageway 58 formed between the upper nozzle wall 50 and the lower nozzle wall 54. The suction nozzle 42 includes an inlet 62 that is configured to extract fluid from the surface to be cleaned 14 and an outlet 66 that is spaced from the inlet 62.

A suction duct 70 is connected to the base 18 and has a first end that is connected to the outlet 66 of the suction nozzle 42 and a second end that is connected to the recovery tank 26.

The brush assembly 46 is connected to a lower surface 74 of the base 18 adjacent the distribution nozzle and suction nozzle 42 to scrub the surface 14. The brush assembly 46 includes the brushroll chamber 78, a first brushroll 82 and a second brushroll 86. The brushroll chamber 78 defines a top surface having a top opening and a bottom surface having a bottom opening positioned closer to the surface to be cleaned 14 than the top opening during operation of the extractor 10. In the illustrated embodiment, the top surface of the brushroll chamber 78 is formed by the lower nozzle wall 54, and the bottom surface is open to permit the brushrolls 82 and 86 to engage the surface to be cleaned 14.

In some embodiments, the brushrolls 82 and 86 of the brush assembly 46 may be electrically or pneumatically rotated to agitate and scrub the surface. The first brushroll 82 is configured to rotate about a first axis and the second brushroll 86 is configured to rotate about a second axis, substantially parallel to the first axis. The first brushroll 82 and the second brushroll 86 can each rotate clockwise or counterclockwise when viewed from the side as shown in FIG. 2. In some embodiments, the first brushroll 82 and the second brushroll 86 rotate in the same rotational direction and in other embodiments, first brushroll 82 and the second brushroll 86 rotate in opposite rotational directions.

FIGS. 1 and 2 also illustrate that the nozzle passageway 58 has a variable cross section extending from the nozzle inlet 62 to the nozzle outlet 66. Specifically, at the nozzle inlet 62, the nozzle passageway 58 extends along the brushroll chamber 78, and may have a width approximately equal to or greater than the width of the brushroll chamber. In contrast, at the nozzle outlet 66, the nozzle passageway 58 extends along a lesser width that substantially corresponds to an inlet end of the suction duct 70. At the nozzle inlet 62, the nozzle passageway 58 has a height that is relatively small, but at the nozzle outlet 66, the nozzle passageway 58 has a height that is relatively large, generally maintaining a similar cross-sectional area along the passageway (see FIG. 2).

The lower nozzle wall 54 extends across the entire top opening of the brushroll chamber 78. In fact, the lower nozzle wall 54 has a greater width than the top opening of the brushroll chamber 78 such that the lower nozzle wall 54 fully covers the top opening of the brushroll chamber 78 while the suction nozzle 42 is installed.

Figure 3:
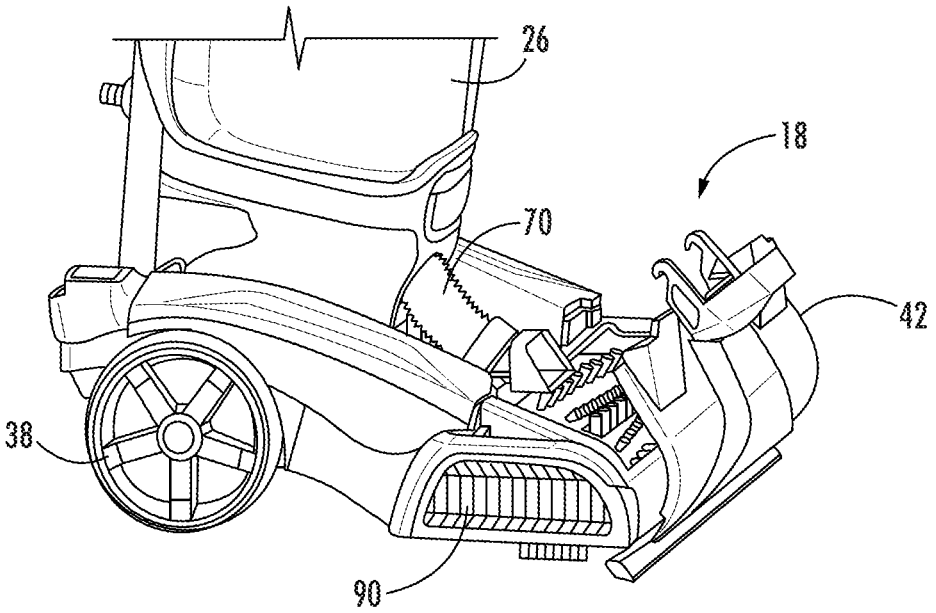
FIG. 3 is a side perspective view of the lower portion of the extractor cleaning machine shown in FIG. 1 with a portion of a body partially removed.

FIG. 3 illustrates the suction nozzle 42 in a partially removed position in which the suction nozzle 42 is pivoted away from the base 18 to remove the suction nozzle 42 from the base 18. The suction nozzle 42 is selectively removable from the base 18 to permit a user to access an interior of the base 18 and to selectively cover the top opening of the brushroll chamber 78. The suction nozzle 42 is pivotable about an axis substantially parallel to the first axis about which the first brushroll 82 rotates and substantially parallel to the second axis about which the second brushroll 86 rotates. In one embodiment, the suction nozzle 42 lifts from or translates from the base 18 for removal. The suction nozzle 42 is connected to the suction duct 70 when the suction nozzle 42 is connected to the brushroll chamber 78 and is disconnected and spaced from the suction duct 70 when the suction nozzle 42 is disconnected from the brushroll chamber 78. The suction nozzle 42 communicates with the recovery tank 26 via the suction duct 70 while the suction nozzle 42 is connected to the brushroll chamber 78.

Figure 5:
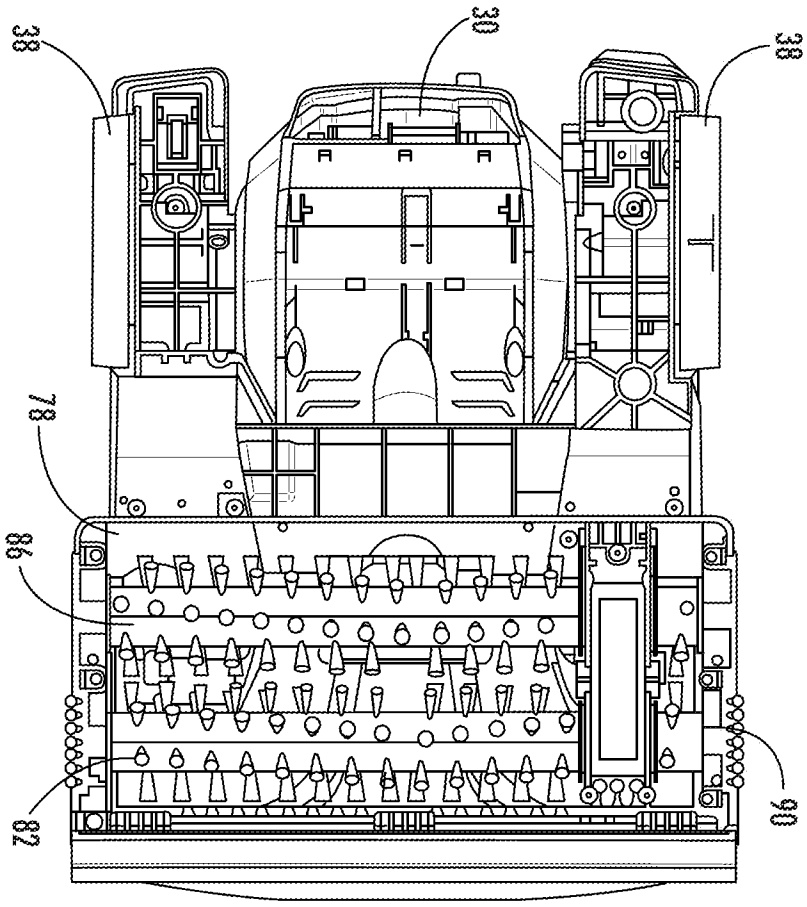
FIG. 5 is a bottom view of the extractor cleaning machine shown in FIG. 1.

The lower nozzle wall 54 is configured to cover a top surface of the top opening of the brushroll chamber 78 while the suction nozzle 42 is installed (see FIG. 2) and is configured to uncover the top surface of the top opening of the brushroll chamber 78 while the suction nozzle 42 is removed (see FIG. 5).

FIG. 3 also illustrates a side cover 90 selectively covering a side opening of the brushroll chamber 78. In some embodiments, the side cover 90 can be removed from the brushroll chamber 78 to expose a side opening. At least one of the first brushroll 82 and the second brushroll 86 can be accessed and optionally removed through the side opening 94 while the side cover 90 is disconnected from the brushroll chamber.

Figure 4:
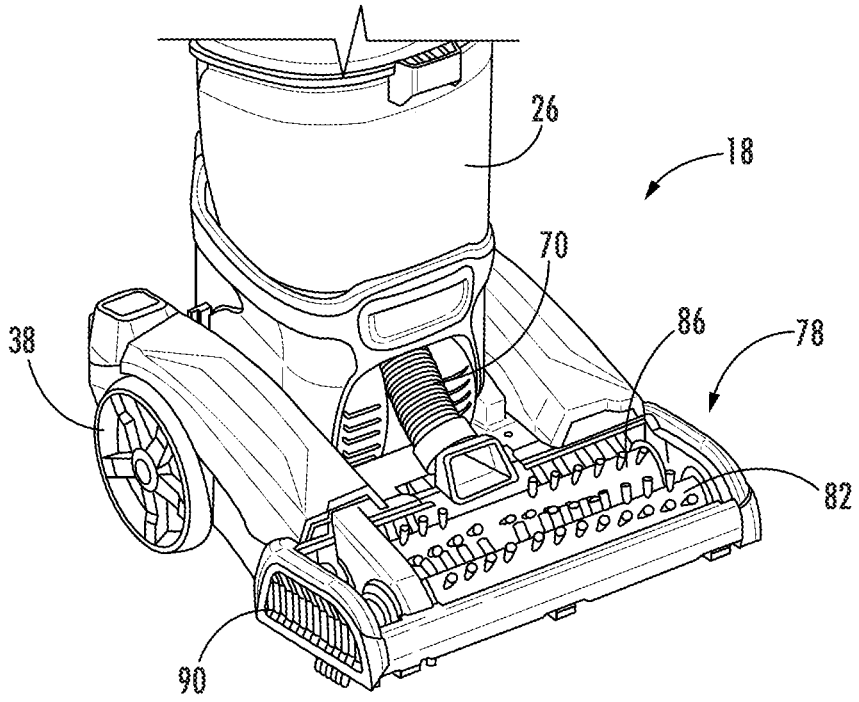
FIG. 4 is a side perspective view of the lower portion of the extractor cleaning machine shown in FIG. 1 with a portion of a body removed.

FIG. 4 illustrates the suction nozzle 42 fully removed from the base 18 of the extractor 10. The brushroll chamber 78 is open to permit access to the first brushroll 82 and the second brushroll 86 through the top opening for cleaning while the suction nozzle 42 is disconnected from the brushroll chamber 78. The first brushroll 82 has a first brushroll width, the second brushroll 86 has a second brushroll width, and the top opening of the brushroll chamber 78 has a top opening width. In one embodiment, the first brushroll width is greater than the top opening width, and the second brushroll width is greater than the top opening width. The first brushroll 82 is not removable from the top opening of the brushroll chamber 78. Likewise, the second brushroll 86 is not removable from the top opening of the brushroll chamber 78.

FIG. 5 illustrates the bottom opening of the brushroll chamber 78. A bracket 98 extends across the bottom opening of the brushroll chamber 78. The illustrated bracket 98 is positioned near the side cover 90. The bracket 98 partially encases a driving member (such as a belt) that is configured to rotate the first brushroll 82 and the second brushroll 86 in response to one or more prime movers. The bracket 98 is removable from the brushroll chamber 78 to permit removal of the first brushroll 82 and the second brushroll 86 through the bottom opening of the brushroll chamber 78. The suction nozzle 42 can be connected to or disconnected from the brushroll chamber 78 while the first brushroll 82 and the second brushroll 86 are removed through the bottom opening of the brushroll chamber 78.

The first brushroll 82 and the second brushroll 86 are removable from the brushroll chamber 78 through the bottom opening while the bracket 98 is removed and can be removable through a side opening while the side cover 90 is removed. The first brushroll 82 and the second brushroll 86 are accessible, but not removable through the top opening of the brushroll chamber 78 while the suction nozzle 42 is disconnected from the brushroll chamber 78.

What is claimed is:

1. A floor cleaner comprising:

a cleaning head housing movable along a surface to be cleaned, the cleaning head housing including a brushroll chamber defining a top opening and a bottom opening, a suction nozzle having an upper nozzle wall, a lower nozzle wall, and a nozzle passageway formed between the upper nozzle wall and the lower nozzle wall, the suction nozzle being releaseably connected to the brushroll chamber to selectively cover the top opening of the brushroll chamber, a brushroll positioned within the brushroll chamber, the brushroll configured to engage the surface to be cleaned through the bottom opening of the brushroll chamber during operation, the brushroll being accessible through the top opening for cleaning while the suction nozzle is disconnected from the brushroll chamber, the brushroll being removable from the brushroll chamber other than through the top opening;

a body portion pivotally coupled to the cleaning head housing;

a suction source in fluid communication with the suction nozzle, the suction source operable to draw fluid into the suction nozzle; and a recovery tank in fluid communication with the suction nozzle and the suction source, the recovery tank configured to store fluid drawn through the suction nozzle.

2. The floor cleaner of claim 1, wherein the brushroll is removable from the brushroll chamber through the bottom opening.

3. The floor cleaner of claim 1, wherein the brushroll chamber includes a side opening and the cleaning head housing includes a side cover selectively covering the side opening, and wherein the brushroll is removable from the brushroll chamber through the side opening while the side cover is disconnected from the brushroll chamber.

4. The floor cleaner of claim 1, wherein the lower nozzle wall has a lower nozzle wall width, and the top opening has a top opening width, wherein the lower nozzle wall width is greater than the top opening width.

5. The floor cleaner of claim 1, wherein the cleaning head housing includes a suction duct, wherein the suction nozzle connects to the suction duct when the suction nozzle is connected to the brushroll chamber and is disconnected and spaced from the suction duct when the suction nozzle is disconnected from the brushroll chamber, and the suction nozzle communicates with the recovery tank via the suction duct while the suction nozzle is connected to the brushroll chamber.

6. The floor cleaner of claim 5, wherein the brushroll defines a brushroll axis, wherein the suction nozzle pivots forward about an axis parallel to the brushroll axis as the suction nozzle is being moved from being connected to the brushroll chamber to being disconnected from the brushroll chamber.

7. The floor cleaner of claim 1, wherein the brushroll has a brushroll width and the top opening of the brushroll chamber has a top opening width, wherein the brushroll width is greater than the top opening width.

8. A cleaning head housing for a floor cleaner movable along a surface to be cleaned, the cleaning head housing comprising:

a brushroll chamber defining a top surface having a top opening and a bottom surface having a bottom opening positioned closer to the surface to be cleaned than the top opening during operation of the floor cleaner;

a suction nozzle having an upper nozzle wall, a lower nozzle wall, and a nozzle passageway formed between the upper nozzle wall and the lower nozzle wall, the suction nozzle being releaseably connected to the brushroll chamber to selectively cover the top opening of the brushroll chamber; and a brushroll positioned within the brushroll chamber, the brushroll configured to engage the surface to be cleaned through the bottom opening of the brushroll chamber during operation, wherein the brushroll is accessible through the top opening for cleaning while the suction nozzle is disconnected from the brushroll chamber, and wherein the brushroll is removable from the brushroll chamber other than through the top opening.

9. The cleaning head housing of claim 8, wherein the brushroll is removable from the brushroll chamber through the bottom opening.

10. The cleaning head housing of claim 8, wherein the brushroll chamber includes a side opening and the cleaning head housing includes a side cover selectively covering the side opening, and wherein the brushroll is removable from the brushroll chamber through the side opening while the side cover is disconnected from the brushroll chamber.

11. The cleaning head housing of claim 8, wherein the lower nozzle wall has a lower nozzle wall width, and the top opening has a top opening width, wherein the lower nozzle wall width is greater than the top opening width.

12. The cleaning head housing of claim 8, wherein the cleaning head housing includes a suction duct, wherein the suction nozzle connects to the suction duct when the suction nozzle is connected to the brushroll chamber and is disconnected and spaced from the suction duct when the suction nozzle is disconnected from the brushroll chamber, and the suction nozzle communicates with the recovery tank via the suction duct while the suction nozzle is connected to the brushroll chamber.

13. The cleaning head housing of claim 12, wherein the brushroll defines a brushroll axis, wherein the suction nozzle pivots forward about an axis parallel to the brushroll axis as the suction nozzle is being moved from being connected to the brushroll chamber to being disconnected from the brushroll chamber.

14. The cleaning head housing of claim 8, wherein the brushroll has a brushroll width and the top opening of the brushroll chamber has a top opening width, wherein the brushroll width is greater than the top opening width.

15. A floor cleaner comprising:

a cleaning head housing movable along a surface to be cleaned, the cleaning head housing including a brushroll chamber defining a top opening, a bottom opening, and, optionally a side opening, a dispensing nozzle configured to dispense fluid onto the surface to be cleaned;

a suction nozzle having an upper nozzle wall, a lower nozzle wall, and a nozzle passageway formed between the upper nozzle wall and the lower nozzle wall, the suction nozzle being releaseably connected to the brushroll chamber to selectively close the top opening of the brushroll chamber, and a brushroll positioned within the brushroll chamber, the brushroll configured to engage the surface to be cleaned through the bottom opening of the brushroll chamber, the brushroll being accessible through the top opening for cleaning while the suction nozzle is disconnected from the brushroll chamber, the brushroll being removable from the brushroll chamber other than through the top opening;

a body portion pivotally coupled to the brushroll chamber;

a supply tank configured to supply fluid to the dispensing nozzle;

a suction source connected to the body portion, the suction source in fluid communication with the suction nozzle, the suction source operable to draw fluid into the suction nozzle from the surface to be cleaned; and a recovery tank in fluid communication with the suction nozzle and the suction source, the recovery tank configured to store fluid drawn through the suction nozzle.

16. The floor cleaner of claim 15, wherein the brushroll is removable from the brushroll chamber through the bottom opening.

17. The floor cleaner of claim 16, wherein the cleaning head housing includes a side cover selectively covering the side opening, and wherein the brushroll is removable from the brushroll chamber through the side opening while the side cover is disconnected from the brushroll chamber.

18. The floor cleaner of claim 15, wherein the cleaning head housing includes a side cover selectively covering the side opening, and wherein the brushroll is removable from the brushroll chamber through the side opening while the side cover is disconnected from the brushroll chamber.

19. The floor cleaner of claim 15, wherein the cleaning head housing includes a suction duct, wherein the suction nozzle connects to the suction duct when the suction nozzle is connected to the brushroll chamber and is disconnected and spaced from the suction duct when the suction nozzle is disconnected from the brushroll chamber, and the suction nozzle communicates with the recovery tank via the suction duct while the suction nozzle is connected to the brushroll chamber.

20. The floor cleaner of claim 15, wherein the brushroll defines a brushroll axis, wherein the suction nozzle pivots forward about an axis parallel to the brushroll axis as the suction nozzle is being moved from being connected to the brushroll chamber to being disconnected from the brushroll chamber.

* * * * *